US009995018B2

(12) United States Patent
Egawa et al.

(10) Patent No.: US 9,995,018 B2
(45) Date of Patent: Jun. 12, 2018

(54) CONTROL SYSTEM OF HYBRID CONSTRUCTION MACHINE

(71) Applicant: KYB Corporation, Tokyo (JP)

(72) Inventors: Masahiro Egawa, Saitama (JP); Haruhiko Kawasaki, Kanagawa (JP)

(73) Assignee: KYB Corporation, Tokyo (JP)

( * ) Notice: Subject to any disclaimer, the term of this patent is extended or adjusted under 35 U.S.C. 154(b) by 211 days.

(21) Appl. No.: 15/102,548

(22) PCT Filed: Dec. 2, 2014

(86) PCT No.: PCT/JP2014/081906

§ 371 (c)(1),
(2) Date: Jun. 8, 2016

(87) PCT Pub. No.: WO2015/111304

PCT Pub. Date: Jul. 30, 2015

(65) Prior Publication Data

US 2016/0312442 A1 Oct. 27, 2016

(30) Foreign Application Priority Data

Jan. 24, 2014 (JP) ..... 2014-011518

(51) Int. Cl.
*E02F 9/22* (2006.01)
*F15B 21/14* (2006.01)
(Continued)

(52) U.S. Cl.
CPC ..... *E02F 9/2217* (2013.01); *E02F 9/2075* (2013.01); *E02F 9/2091* (2013.01);
(Continued)

(58) Field of Classification Search
CPC ..... E02F 9/2217; E02F 9/2075; F15B 21/14
See application file for complete search history.

(56) References Cited

U.S. PATENT DOCUMENTS 8,720,196 B2 * 5/2014 Kawasaki ..... E02F 9/2075 60/422
9,037,356 B2 * 5/2015 Kawasaki ..... E02F 9/2075 701/50

(Continued)

FOREIGN PATENT DOCUMENTS

| | | | |
|---|---|---|---|
| CN | 101220823 | A | 7/2008 |
| CN | 102388227 | A | 3/2012 |
| JP | 2007-327527 | A | 12/2007 |
| JP | 2009-287745 | A | 12/2009 |

*Primary Examiner* — Thomas E Lazo
*Assistant Examiner* — Michael Quandt
(74) *Attorney, Agent, or Firm* — Rabin & Berdo, P.C.

(57) ABSTRACT

A control system of a hybrid construction machine includes a regeneration passage switching valve having a normal position where flow of working fluid is blocked, and a regeneration position allowing for the working fluid to flow from main passages to a regeneration motor when a working fluid pressure of the main passages reaches a set pressure during operation of the actuators, and an assist switching valve having a normal position proportionally dividing the working fluid of an assist passage into a regeneration passages, a first switching position supplying more working fluid of the assist passage to one of the main passages when that the one has a higher working fluid pressure, and a second switching position supplying more working fluid of the assist passage to the other one of the main passages when that the other one has a higher working fluid pressure.

6 Claims, 8 Drawing Sheets

(51) Int. Cl.

| | |
|---|---|
| ***E02F 9/20*** | (2006.01) |
| ***F15B 13/044*** | (2006.01) |
| ***F15B 21/08*** | (2006.01) |

(52) U.S. Cl.

CPC ..... *E02F 9/2235* (2013.01); *E02F 9/2267* (2013.01); *E02F 9/2282* (2013.01); *E02F 9/2285* (2013.01); *E02F 9/2296* (2013.01); *F15B 13/044* (2013.01); *F15B 21/08* (2013.01); *F15B 21/14* (2013.01); *E02F 9/2292* (2013.01); *F15B 2211/20515* (2013.01); *F15B 2211/20523* (2013.01); *F15B 2211/20546* (2013.01); *F15B 2211/20576* (2013.01); *F15B 2211/255* (2013.01); *F15B 2211/265* (2013.01); *F15B 2211/6313* (2013.01); *F15B 2211/6316* (2013.01); *F15B 2211/7053* (2013.01); *F15B 2211/7058* (2013.01); *F15B 2211/7135* (2013.01); *F15B 2211/7142* (2013.01); *F15B 2211/88* (2013.01)

(56) References Cited

U.S. PATENT DOCUMENTS

| | | | | |
|---|---|---|---|---|
| 9,127,438 | B2 * | 9/2015 | Kawasaki ..... | E02F 9/2075 |
| 2008/0110165 | A1 | 5/2008 | Hamkins et al. | |
| 2008/0110166 | A1 | 5/2008 | Stephenson et al. | |
| 2011/0072810 | A1 | 3/2011 | Kawasaki et al. | |
| 2011/0265467 | A1 | 11/2011 | Kawasaki | |

* cited by examiner

CONTROL SYSTEM OF HYBRID CONSTRUCTION MACHINE

TECHNICAL FIELD

The present invention relates to a control system of a hybrid construction machine.

BACKGROUND ART

Conventionally, hybrid construction machines making use of hydraulic oil guided from an actuator to rotate an oil-hydraulic motor and regenerate energy is known.

JP2009-287745A discloses a hybrid construction machine including a boom cylinder and a swing motor, rotating an oil-hydraulic motor for energy regeneration by using hydraulic oil guided from the boom cylinder upon lowering the boom and hydraulic oil guided from the swing motor during a swinging operation.

SUMMARY OF INVENTION

However, with the hybrid construction machine disclosed in JP2009-287745A, no excess hydraulic energy can be regenerated while an actuator other than the boom cylinder or swing motor is being operated.

It is an object of the present invention to provide a control system of a hybrid construction machine that is capable of regenerating excess hydraulic energy even while an actuator other than a boom cylinder or a swing motor is being operated.

According to one aspect of the present invention, a control system of a hybrid construction machine, includes: two circuitry systems each having a main pump and an operation valve, the operation valve being configured to supply and discharge working fluid supplied from the main pump to an actuator through a main passage; a main relief valve disposed in at least one of the two circuitry systems, the main relief valve being configured to maintain the working fluid pressure of the main passage at not more than a main relief pressure; two regeneration passages each branching out between the main pump and the operation valve of the main passage of the two circuitry systems; a regeneration motor for regeneration, configured to rotate by the working fluid guided through one of the regeneration passages of the two circuitry systems; an assist pump configured to supply the working fluid to the two main passages via an assist passage by rotation with the regeneration motor interlockingly; a regeneration passage switching valve configured to open and close one of the regeneration passages of the two circuitry systems; and an assist switching valve interposed on the assist passage, the assist switching valve being configured to supply the working fluid supplied from the assist pump to at least one of the two regeneration passages, wherein the regeneration passage switching valve includes a normal position where flow of the working fluid is blocked, and a regeneration position allowing for the working fluid to flow from the main passage to the regeneration motor when the working fluid pressure of the main passage reaches a set pressure lower than the main relief pressure during operation of the actuator, and the assist switching valve includes a normal position proportionally dividing the working fluid of the assist passage into the two regeneration passages, a first switching position supplying more working fluid of the assist passage to one of the two main passages when that the one of the two main passages has a higher working fluid pressure, and a second switching position supplying more working fluid of the assist passage to the other one of the two main passages when that the other one of the two main passages has a higher working fluid pressure.

DESCRIPTION OF EMBODIMENTS

Described below is an embodiment of the present invention, with reference to the drawings.

First Embodiment

Figure 1:
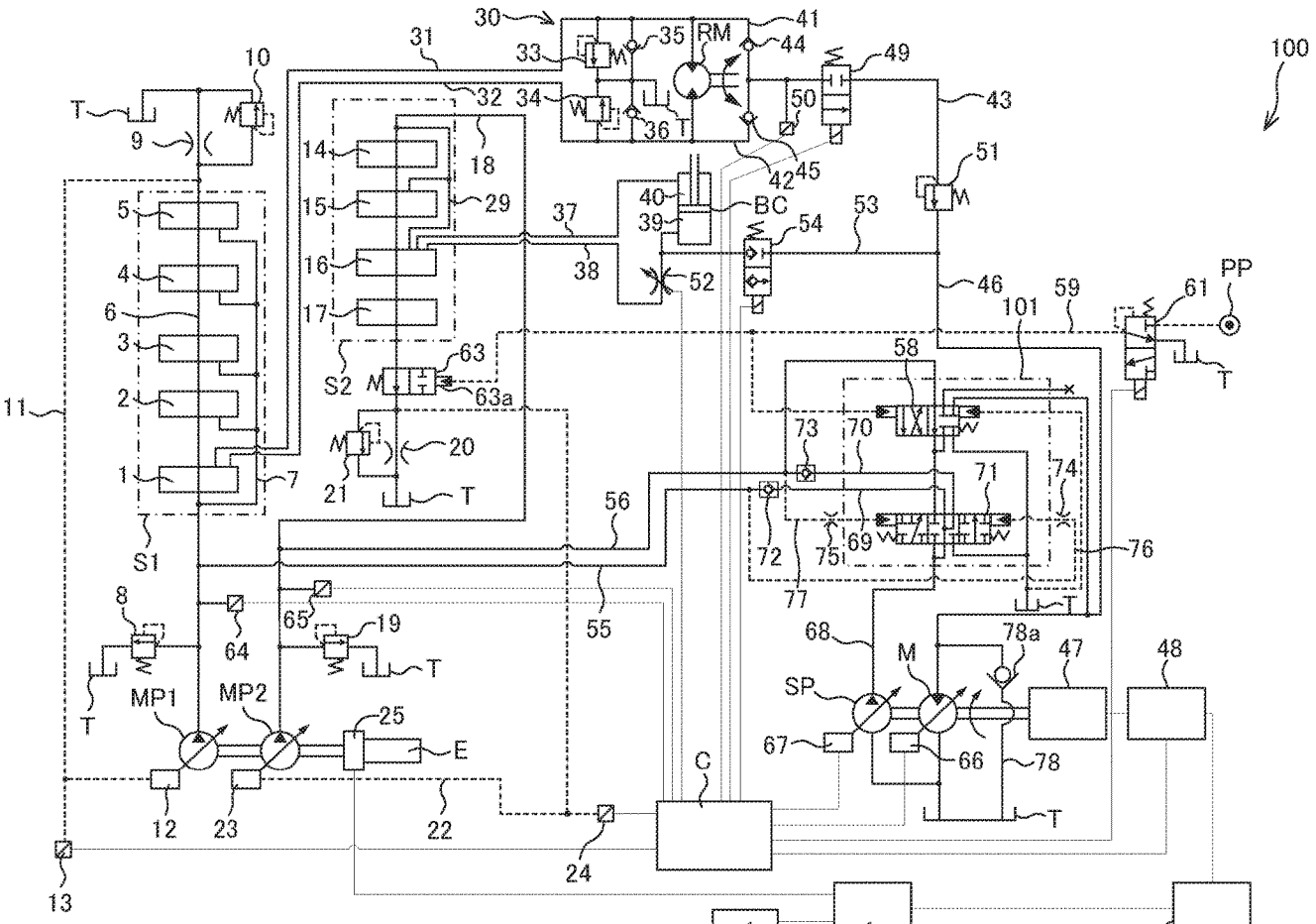
FIG. 1 is a circuit diagram of a control system of a hybrid construction machine according to a first embodiment of the present invention.
Figure 2:
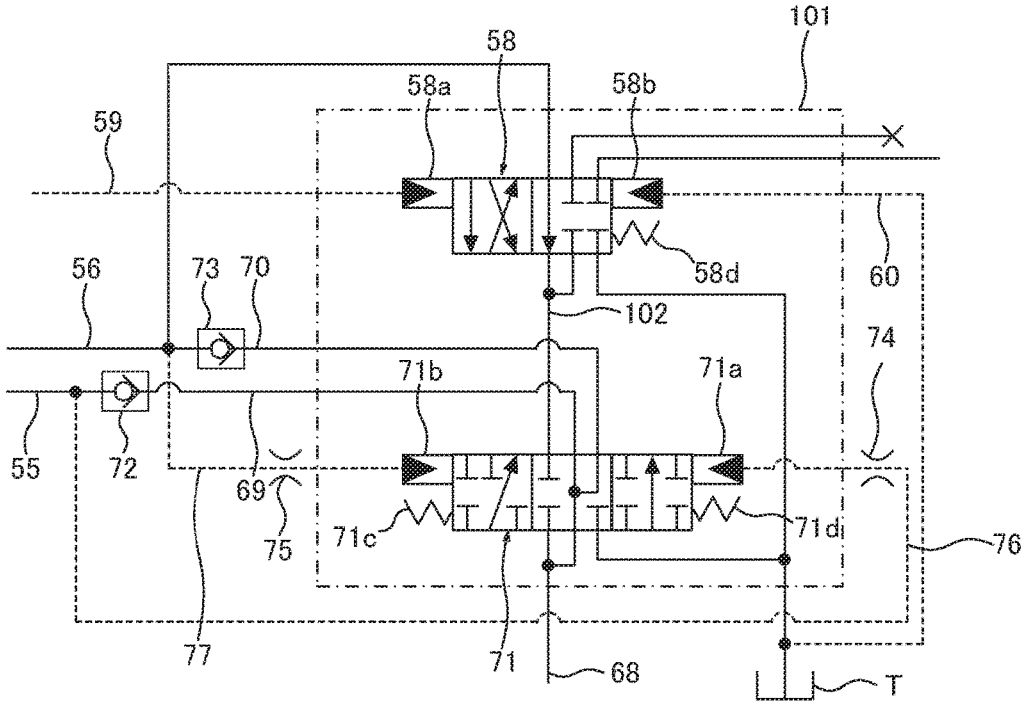
FIG. 2 is an enlarged view of a regeneration passage switching valve and a high pressure selection switching valve in FIG. 1.

With reference to FIG. 1 and FIG. 2, the following describes a control system 100 of a hybrid construction machine according to a first embodiment of the present invention. Described herein is a case in which the hybrid construction machine is a hydraulic excavator. In the hydraulic excavator, hydraulic oil is used as working fluid.

First described is an overall configuration of the control system 100 of the hybrid construction machine, with reference to FIG. 1.

The hydraulic excavator includes: a first main pump MP1 and a second main pump MP2 for discharging hydraulic oil to drive each of the actuators; a first circuitry system S1 to which hydraulic oil is supplied from the first main pump MP1; and a second circuitry system S2 to which hydraulic oil is supplied from the second main pump MP2.

The first main pump MP1 and the second main pump MP2 are variable displacement pumps having adjustable swash plate tilt angles. The first main pump MP1 and the second main pump MP2 are driven and rotated coaxially by an engine E.

The first circuitry system S1 has, in order from its upstream side, an operation valve 1 for controlling a swing motor RM, an operation valve 2 for controlling an arm cylinder (omitted in illustration), a two-speed boom operation valve 3 for controlling a boom cylinder BC as a fluid pressure cylinder, an operation valve 4 for controlling spare attachments such as a breaker or a crusher (omitted in illustration), and an operation valve 5 for controlling a first traction motor for left traveling (omitted in illustration).

Each of the operation valves 1 to 5 control the movement of the actuators by controlling the amount of flow of the hydraulic oil guided to the actuators from the first main pump MP1. Each of the operation valves 1 to 5 are operated by a pilot pressure supplied accompanied with a manual operation of an operation lever by an operator of the hydraulic excavator.

The operation valves 1 to 5 are connected to the first main pump MP1 via a neutral flow path 6 and a parallel passage 7 that serve as main passages parallel to each other. In upstream of the operation valve 1 in the neutral flow path 6, a main relief valve 8 opening when the hydraulic oil pressure of the neutral flow path 6 exceeds a predetermined main relief pressure to maintain the hydraulic oil pressure to not more than the predetermined main relief pressure is provided. The predetermined main relief pressure is set high enough to sufficiently ensure a minimum operating pressure of each of the operation valves 1 to 5.

In downstream of the operation valve 5 in the neutral flow path 6, a throttle 9 for generating pilot pressure (negative control pressure) is provided. The throttle 9 generates a high pilot pressure upstream if the amount of flow passing therethrough is large, and generates a low pilot pressure upstream if the amount of flow passing therethrough is small.

The throttle 9 has a pilot relief valve 10 provided parallel thereto, which pilot relief valve 10 opens when the pilot pressure generated upstream of the throttle 9 exceeds a predetermined pilot relief pressure to maintain the pilot pressure to not more than the predetermined pilot relief pressure. The predetermined pilot relief pressure is set lower than a main relief pressure of the main relief valve 8 to an extent that no abnormal pressure will occur on the throttle 9.

The neutral flow path 6 guides all or a portion of the hydraulic oil discharged from the first main pump MP1 to a tank T, in a case in which all of the operation valves 1 to 5 are at neutral positions or are in the vicinity of their neutral positions. In this case, the amount of flow of the hydraulic oil passing through the throttle 9 increases, thus generating a high pilot pressure.

On the other hand, when the operation valves 1 to 5 are switched to full stroke, the neutral flow path 6 becomes closed and no hydraulic oil is distributed. In this case, hardly any amount of hydraulic oil is flown through the throttle 9, thus maintaining the pilot pressure at 0. However, depending on the operated amount of the operation valves 1 to 5, a portion of the hydraulic oil discharged from the first main pump MP1 is guided to the actuators, and the remainder is guided from the neutral flow path 6 to the tank T. This thus allows for the generation of a pilot pressure by the throttle 9 in accordance with the amount of flow of the hydraulic oil of the neutral flow path 6. That is to say, the throttle 9 generates a pilot pressure in accordance with an operated amount of the operation valves 1 to 5.

A pilot flow path 11 is connected upstream of the throttle 9. The pilot pressure generated by the throttle 9 is guided to the pilot flow path 11. The pilot flow path 11 is connected to a regulator 12 for controlling a capacity of the first main pump MP1 (tilt angle of swash plate).

The regulator 12 controls the tilt angle of the swash plate of the first main pump MP1 in proportion to the pilot pressure of the pilot flow path 11 (proportionality constant is a negative number), to control displacement per rotation of the first main pump MP1. Therefore, if the operation valves 1 to 5 are switched to full stroke and no flow of hydraulic oil passes through the throttle 9, thereby achieving a pilot pressure of 0 in the pilot flow path 11, the tilt angle of the swash plate of the first main pump MP1 becomes maximum and the displacement per rotation is maximized.

The pilot flow path 11 is provided with a pressure sensor 13 that detects the pressure of the pilot flow path 11. A pressure signal detected by the pressure sensor 13 is outputted to a controller C. The pilot pressure of the pilot flow path 11 varies depending on the operated amount of the operation valves 1 to 5. Hence, the pressure signal detected by the pressure sensor 13 is proportional to a requested amount of flow of the first circuitry system S1.

The second circuitry system S2 has, in order from the upstream side, an operation valve 14 for controlling a second traction motor for right traveling (omitted in illustration), an operation valve 15 for controlling a bucket cylinder (omitted in illustration), an operation valve 16 for controlling a boom cylinder BC, and a two-speed arm operation valve 17 for controlling an arm cylinder (omitted in illustration).

Each of the operation valves 14 to 17 control the amount of flow of the hydraulic oil guided from the second main pump MP2 to the actuators, to control the movement of the actuators. Each of the operation valves 14 to 17 is operated by a pilot pressure supplied accompanied with a manual operation of an operation lever by an operator of the hydraulic excavator.

The operation valves 14 to 17 are connected to the second main pump MP2 via a neutral flow path 18 serving as a main passage. Moreover, the operation valves 14 to 16 are connected to the second main pump MP2 via a parallel passage 29 parallel to the neutral flow path 18. Provided upstream of the operation valve 14 in the neutral flow path 18 is a main relief valve 19 that opens when the hydraulic oil pressure of the neutral flow path 18 exceeds a predetermined main relief pressure, to maintain the hydraulic oil pressure to not more than the main relief pressure. The predetermined main relief pressure is set high to an extent capable of sufficiently securing a minimum operating pressure of the operation valves 14 to 17.

The main relief valves 8 and 19 are to be provided in at least one of the first circuitry system S1 and the second circuitry system S2. In a case in which just one of the first circuitry system S1 and second circuitry system S2 is provided with the main relief valve, connection is established so that the hydraulic oil will be guided to the same main relief valve also from the other one of the first circuitry system S1 and second circuitry system S2. As such, in a case in which a main relief valve is provided singly, the main relief valve is shared between the first circuitry system S1 and the second circuitry system S2.

Provided downstream of the operation valve 17 of the neutral flow path 18 is a throttle 20 for generating a pilot pressure (negative control pressure). The throttle 20 has the same function as the throttle 9 provided for the first main pump MP1.

The throttle 20 has a pilot relief valve 21 provided parallel thereto. The pilot relief valve 21 opens when the pilot pressure generated upstream of the throttle 20 exceeds a predetermined pilot relief pressure, to maintain the pilot pressure to not more than the predetermined pilot relief pressure. The predetermined pilot relief pressure is set lower than the main relief pressure of the main relief valve 19 to an extent that no abnormal pressure will occur on the throttle 20.

Connected upstream of the throttle 20 is a pilot flow path 22, and the pilot pressure generated by the throttle 20 is guided to the pilot flow path 22. The pilot flow path 22 is connected to a regulator 23 for controlling a capacity of the second main pump MP2 (tilt angle of the swash plate).

The regulator 23 controls the tilt angle of the swash plate of the second main pump MP2 in proportion to the pilot pressure of the pilot flow path 22 (proportionality constant is a negative number), to control the displacement per rotation of the second main pump MP2. Therefore, when the operation valves 14 to 17 are switched to full stroke and no flow of hydraulic oil passes through the throttle 20, thereby causing the pilot pressure of the pilot flow path 22 to be 0, the tilt angle of the swash plate of the second main pump MP2 becomes maximum and the displacement per rotation is maximized.

The pilot flow path 22 is provided with a pressure sensor 24 for detecting a pressure of the pilot flow path 22. The pressure signal detected by the pressure sensor 24 is outputted to the controller C. The pilot pressure of the pilot flow path 22 varies depending on the operated amount of the operation valves 14 to 17. Thus, the pressure signal detected by the pressure sensor 24 is proportional to the requested amount of flow of the second circuitry system S2.

The engine E is provided with a generator 25 for generating electricity by using remaining power of the engine E. The electric power generated by the generator 25 is charged to a battery 27 via a battery charger 26. The battery charger 26 can charge electric power to the battery 27 even when connected to a general household power source 28.

Next described is the swing motor RM.

The swing motor RM is provided in a swing circuit 30 for driving the swing motor RM. The swing circuit 30 includes a pair of supply-discharge passages 31 and 32 which connect the first main pump MP1 with the swing motor RM and between which the operation valve 1 is interposed, and relief valves 33 and 34 connected to the supply-discharge passages 31 and 32, respectively, which relief valves 33 and 34 open at a set pressure.

The operation valve 1 is a three-position switching valve. When the operation valve 1 is in neutral position, an actuator port of the operation valve 1 is closed, which blocks the supply and discharge of hydraulic oil with respect to the swing motor RM, and the swing motor RM maintains a stopped state.

When the operation valve 1 is switched to one position, the supply-discharge passage 31 becomes connected to the first main pump MP1, and the supply-discharge passage 32 communicates with the tank T. As a result, the hydraulic oil is supplied through the supply-discharge passage 31 and the swing motor RM rotates, and also the hydraulic oil returning from the swing motor RM passes through the supply-discharge passage 32 and is discharged to the tank T. On the other hand, when the operation valve 1 is switched to the other position, the supply-discharge passage 32 becomes connected to the first main pump MP1, the supply-discharge passage 31 communicates with the tank T, and the swing motor RM rotates in a reverse direction.

When the swinging pressure of the supply-discharge passages 31 and 32 reach a set pressure of the relief valves 33 and 34 during a swinging movement of the swing motor RM, the relief valves 33 and 34 open, and an excess amount of flow on the higher pressure side is guided to the lower pressure side.

When the operation valve 1 is switched to neutral position during the swinging movement of the swing motor RM, the actuator port of the operation valve 1 becomes closed. As a result, a closed circuit is configured by the supply-discharge passages 31 and 32, the swing motor RM, and the relief valves 33 and 34. As such, even if the actuator port of the operation valve 1 is closed, the swing motor RM continues to rotate by inertial energy and exerts a pump action.

As a result, this causes one of the supply-discharge passages 31 and 32 which was of a low pressure during the swinging movement to become a high pressure, and the other one of the supply-discharge passages 31 and 32 of a high pressure during the swinging movement to become a low pressure. Accordingly, a brake force acts on the swing motor RM and a brake action is carried out. At this time, when the brake pressure of the supply-discharge passages 31 and 32 reaches a set pressure of the relief valves 33 and 34, the relief valves 33 and 34 open and the brake flow amount on the higher pressure side is guided to the lower pressure side.

In a case in which a suction flow amount of the swing motor RM is insufficient at the time of brake action of the swing motor RM, the hydraulic oil of the tank T is sucked in via check valves 35 and 36 that allow for only the flow of hydraulic oil from the tank T to the supply-discharge passages 31 and 32.

Next described is the boom cylinder BC.

The operation valve 16 that controls the operation of the boom cylinder BC is a three-position switching valve. When the operation valve 16 is switched from neutral position to one position, the hydraulic oil discharged from the second main pump MP2 is supplied to a piston side chamber 39 of the boom cylinder BC via the supply-discharge passage 38, and also the hydraulic oil returning from a rod side chamber 40 is discharged to the tank T through the supply-discharge passage 37. Hence, the boom cylinder BC extends.

On the other hand, when the operation valve 16 is switched to the other position, the hydraulic oil discharged from the second main pump MP2 is supplied to the rod side chamber 40 of the boom cylinder BC through the supply-discharge passage 37, and also the hydraulic oil returning from the piston side chamber 39 is discharged to the tank T through the supply-discharge passage 38. Hence, the boom cylinder BC contracts.

When the operation valve 16 is switched to neutral position, the supplying and discharging of the hydraulic oil with respect to the boom cylinder BC is blocked, and the boom maintains a stopped state. The two-speed boom operation valve 3 is switched when the operated amount of the operation lever by the operator is greater than a predetermined amount.

In a case in which the operation valve 16 is switched to neutral position and the movement of the boom is stopped, force in a contracting direction caused by empty weight of the bucket, arm, boom and the like is applied on the boom cylinder BC. As such, the boom cylinder BC maintains a load by the piston side chamber 39 when the operation valve 16 is in neutral position, and the piston side chamber 39 serves as a load side pressure chamber.

The control system 100 of the hybrid construction machine includes a regeneration device for collecting energy of the hydraulic oil from the swing circuit 30 and the boom cylinder BC, to regenerate energy. The following describes the regeneration device.

Regeneration control by a regeneration device is carried out by the controller C. The controller C includes a CPU (central processing unit) for carrying out regeneration control, a ROM (read on memory) on which control programs, set values and the like that are required for processing operations of the CPU are stored, and a RAM (random access memory) for temporarily storing information detected by various sensors.

First described is a swinging regeneration control that regenerates energy by utilizing the hydraulic oil from the swing circuit 30.

The supply-discharge passages 31 and 32 connected to the swing motor RM are connected to branch passages 41 and 42, respectively. The branch passages 41 and 42 merge and are connected to a swing regeneration passage 43 for guiding the hydraulic oil from the swing circuit 30 to the regeneration motor M for regeneration. The branch passages 41 and 42 are provided with check valves 44 and 45, respectively, the check valves 44 and 45 allow for only the flow of the hydraulic oil from the supply-discharge passages 31 and 32 to the swing regeneration passage 43. The swing regeneration passage 43 is connected to the regeneration motor M via a merging regeneration passage 46.

The regeneration motor M is a variable displacement motor whose swash plate can be adjusted in tilt angle, and is connected to an electric motor 47 serving as a rotating electric machine and a generator, so as to coaxially rotate with the electric motor 47. The regeneration motor M is driven by the hydraulic oil discharged from the swing motor RM or the boom cylinder BC through the merging regeneration passage 46. The regeneration motor M can drive the electric motor 47. In a case in which the electric motor 47 functions as the generator, the electric power generated by the electric motor 47 is charged to the battery 27 via an inverter 48. The regeneration motor M and the electric motor 47 may be directly connected or may be connected via a reduction gear.

Connected upstream of the regeneration motor M is a suction passage 78 that sucks up the hydraulic oil from the tank T to the merging regeneration passage 46 and supplies the hydraulic oil to the regeneration motor M when the supplied amount of hydraulic oil to the regeneration motor M is insufficient. The suction passage 78 is provided with a check valve 78*a* that allows for only the flow of hydraulic oil from the tank T to the merging regeneration passage 46.

The swing regeneration passage 43 is provided with a solenoid operated directional control valve 49 that is controlled in its switching based on a signal outputted from the controller C. A pressure sensor 50 for detecting a swing pressure at a time of swinging operation of the swing motor RM or a brake pressure at the time of brake action is provided between the solenoid operated directional control valve 49 and the check valves 44 and 45. The pressure signal detected by the pressure sensor 50 is outputted to the controller C.

The solenoid operated directional control valve 49 is set in a closed position when the solenoid is in an non-excited state (state shown in FIG. 1), and blocks the swing regeneration passage 43. The solenoid operated directional control valve 49 is switched to an open position when the solenoid is excited, which thus opens the swing regeneration passage 43. The solenoid operated directional control valve 49, when switched to the open position, guides the hydraulic oil from the swing circuit 30 to the regeneration motor M. This thus carries out the swing regeneration.

Described herein is a path of the hydraulic oil from the swing circuit 30 to the regeneration motor M. For example, during the swing movement in which the swing motor RM swings by the hydraulic oil supplied through the supply-discharge passages 31 and 32, excess oil of the supply-discharge passages 31 and 32 flow into the swing regeneration passage 43 through the branch passages 41 and 42 and the check valves 44 and 45, and is guided to the regeneration motor M. Moreover, at the time of the brake action in which the operation valve 1 is switched to neutral position while the swing motor RM is swinging caused by the hydraulic oil supplied through the supply-discharge passage 31 and 32, the hydraulic oil discharged by the pumping action of the swing motor RM flows into the swing regeneration passage 43 via the branch passages 41 and 42 and the check valves 44 and 45, and is guided to the regeneration motor M.

Provided downstream of the solenoid operated directional control valve 49 in the swing regeneration passage 43 is a safety valve 51. The safety valve 51 prevents a runaway of the swing motor RM by maintaining the pressure of the branch passages 41 and 42 in a case in which an abnormality occurs to for example the solenoid operated directional control valve 49 of the swing regeneration passage 43.

In a case in which the controller C determines that the detected pressure by the pressure sensor 50 is equal to or more than a swing regeneration starting pressure, the controller C excites the solenoid of the solenoid operated directional control valve 49. As a result, the solenoid operated directional control valve 49 is switched to the open position and starts the swing regeneration.

If the controller C determines that the detected pressure by the pressure sensor 50 is less than the swing regeneration starting pressure, the controller C ceases the excitation of the solenoid of the solenoid operated directional control valve 49. As a result, the solenoid operated directional control valve 49 is switched to the closed position and stops the swing regeneration.

Next described is the boom regeneration control that regenerates energy by utilization of the hydraulic oil from the boom cylinder BC.

The supply-discharge passage 38 that connects the piston side chamber 39 of the boom cylinder BC with the operation valve 16 is provided with an electromagnetic proportional throttle valve 52 whose opening is controlled by an output signal of the controller C. The electromagnetic proportional throttle valve 52 maintains a fully open position at a normal state.

Connected to the supply-discharge passage 38 is a boom regeneration passage 53 that branches out between the piston side chamber 39 and the electromagnetic proportional throttle valve 52. The boom regeneration passage 53 is a passage for guiding the hydraulic oil returning from the piston side chamber 39 to the regeneration motor M. The swing regeneration passage 43 and the boom regeneration passage 53 merge and connect with the merging regeneration passage 46.

The boom regeneration passage 53 is provided with a solenoid operated directional control valve 54 whose switching is controlled based on a signal outputted from the controller C. The solenoid operated directional control valve 54 is switched to a closed position when the solenoid is in a non-excited state (state shown in FIG. 1), and blocks the boom regeneration passage 53. The solenoid operated directional control valve 54 is switched to the open position when the solenoid is excited, which opens the boom regeneration passage 53 and allows for just the flow of the hydraulic oil from the piston side chamber 39 to the merging regeneration passage 46.

Disposed to the operation valve 16 is a sensor (omitted in illustration) for detecting an operated direction and operated amount of the operation valve 16. The signal detected by the sensor is outputted to the controller C. The controller C calculates an expanding and contracting direction of the boom cylinder BC and its expanding and contracting amount, based on the operated direction and operated amount of the operation valve 16 detected by the sensor.

Instead of the aforementioned sensor, a sensor that detects a moving direction of a piston rod and its moved amount may be disposed in the boom cylinder BC, or a sensor that detects an operated direction and its operated amount may be disposed on the operation lever.

The controller C determines, based on the detection results of the sensor, whether the operator is attempting to extend or to contract the boom cylinder BC. When the controller C determines an extending movement of the boom cylinder BC, the controller C maintains the fully open position being the normal state of the electromagnetic proportional throttle valve 52, and maintains the solenoid operated directional control valve 54 in a closed position.

On the other hand, when the controller C determines a contracting movement of the boom cylinder BC, the controller C calculates a contracting speed of the boom cylinder BC requested by the operator based on the operated amount of the operation valve 16, as well as closing the electromagnetic proportional throttle valve 52 to switch the solenoid operated directional control valve 54 to the open position. As a result, the entire amount of the hydraulic oil returning from the boom cylinder BC is guided to the regeneration motor M, and the boom regeneration is performed.

When the amount of flow consumed at the regeneration motor M is smaller than the amount of flow required for maintaining the contracting speed of the boom cylinder BC requested by the operator, the controller C controls the opening of the electromagnetic proportional throttle valve 52 to return the amount of flow in excess of the amount of flow to be consumed by the regeneration motor M to the tank T, based on the operated amount of the operation valve 16, the tilt angle of the swash plate of the regeneration motor M, and the rotational speed of the electric motor 47. As a result, the contracting speed of the boom cylinder BC requested by the operator is maintained.

When the boom cylinder BC is lowered while the swing motor RM is swung, the hydraulic oil returning from the swing motor RM and the hydraulic oil returning from the boom cylinder BC merge at the merging regeneration passage 46 and are supplied to the regeneration motor M.

At this time, even if the pressure of the swing regeneration passage 43 increases and becomes higher than the swinging pressure or the brake pressure of the swing motor RM, any backward flow of the hydraulic oil within the swing regeneration passage 43 is blocked by the check valves 44 and 45, and thus will not affect the swing motor RM. Moreover, if the pressure of the swing regeneration passage 43 decreases and becomes lower than the swinging pressure or brake pressure, the controller C closes the solenoid operated directional control valve 49 based on the pressure signal from the pressure sensor 50.

Therefore, when the revolving movement of the swing motor RM and the lowering movement of the boom cylinder BC are simultaneously carried out, the tilt angle of the regeneration motor M is defined on the basis of a lowering speed required for the boom cylinder BC, regardless of the swinging pressure or brake pressure.

Described below with reference to FIG. 1 and FIG. 2 is a valve device 101 that performs an excess flow amount regeneration control for collecting energy of the hydraulic oil from the neutral flow path 18 to regenerate energy and an assist control that assists output of the first main pump MP1 and the second main pump MP2 by energy of the hydraulic oil from a sub-pump SP serving as an assist pump.

The valve device 101 includes a regeneration passage switching valve 58 being switched at a time of the excess flow amount regeneration control, and a high pressure selection switching valve 71 being switched at the time of the assist control.

First described is the excess flow amount regeneration control.

The control system 100 of the hybrid construction machine performs an excess flow amount regeneration control that collects energy of hydraulic oil from the neutral flow path 18, to regenerate energy. The excess flow amount regeneration control is performed by the controller C similarly to the swing regeneration control and boom regeneration control.

The upstream side of the operation valve 14 in the neutral flow path 18 of the second circuitry system S2 and the merging regeneration passage 46 are connected by a passage 56 that serves as a regeneration passage. The passage 56 branches out between the second main pump MP2 of the neutral flow path 18 and the operation valve 14, and is connected to the merging regeneration passage 46. The passage 56 is interposed with a regeneration passage switching valve 58 that can open and close the passage 56. Similarly, the passage 55 serving as the regeneration passage branches out between the first main pump MP1 of the neutral flow path 6 and the operation valve 1.

As shown in FIG. 2, the regeneration passage switching valve 58 is a switching valve of a six-port two-position spool type. The regeneration passage switching valve 58 is provided with pilot chambers 58*a* and 58*b* that face either edges of the spool, respectively. The spool is energized unidirectionally by a spring 58*d* provided on one of its ends. The regeneration passage switching valve 58 is usually maintained at a normal position (state shown in FIG. 1 and FIG. 2) by spring force of the spring 58*d*.

The regeneration passage switching valve 58, in a state maintained at the normal position, blocks the flow of the hydraulic oil from the neutral flow path 18 to the merging regeneration passage 46. The regeneration passage switching valve 58 that allows the neutral flow path 102 that communicates with the high pressure selection switching valve 71 to communicate with the passage 56, in any switched position. However, the port on the high pressure selection switching valve 71 side is closed in any switched position. Hence, the hydraulic oil of the neutral flow path 102 will not flow into the high pressure selection switching valve 71.

The regeneration passage switching valve 58 is switched to a regeneration position (left position in FIG. 1) when a pilot pressure is supplied to one of the pilot chambers 58*a*, and allows for the flow of the hydraulic oil from the neutral flow path 18 to the merging regeneration passage 46, and is switched to the normal position when the supply of the pilot pressure is blocked, and closes the passage 56.

The pilot pressure supplied to the pilot chamber 58*a* is supplied from the pilot pressure source PP through a first pilot passage 59. A solenoid proportional reducing valve 61 that serves as a solenoid valve capable of outputting a pilot pressure force in proportion in accordance with a command signal from the controller C is interposed in the first pilot passage 59. The solenoid proportional reducing valve 61 reduces pressure of the pilot pressure source PP when the solenoid is excited, and generates a pilot pressure in accordance with a command value based on a command signal outputted from the controller C, and supplies the pilot pressure to the first pilot passage 59.

Herein, a neutral cut valve 63 that serves as a main passage switching valve capable of opening and closing the neutral flow path 18 is interposed between downstream of the operation valve 17 in the neutral flow path 18 of the second circuitry system S2 and upstream of a connection part of the pilot flow path 22. The neutral cut valve 63 is switched to the closed position when the pilot pressure is supplied to the pilot chamber 63*a* and closes the neutral flow path 18, and is switched to the open position when the supply of the pilot pressure is blocked the neutral cut valve 63 and opens the neutral flow path 18.

The pilot chamber 63*a* of the neutral cut valve 63 is connected to the first pilot passage 59. Hence, when the pilot pressure is supplied to one of the pilot chambers 58*a* of the regeneration passage switching valve 58 caused by the solenoid proportional reducing valve 61, the pilot pressure is supplied simultaneously to the pilot chamber 63*a* of the neutral cut valve 63. That is to say, the neutral cut valve 63 operates in connection with the regeneration passage switching valve 58.

A pressure sensor 64 is provided between the first main pump MP1 and the operation valve 1 in the neutral flow path 6 of the first circuitry system S1, which detects a hydraulic oil pressure of the neutral flow path 6 (discharge pressure of the first main pump MP1). Similarly, a pressure sensor 65 is disposed as a pressure detector that detects the hydraulic oil pressure of the neutral flow path 18 (discharge pressure of the second main pump MP2), between the second main pump MP2 and the operation valve 14 in the neutral flow path 18 of the second circuitry system S2. The pressure signal detected by the pressure sensors 64 and 65 are outputted to the controller C.

The controller C excites the solenoid of the solenoid proportional reducing valve 61 when the hydraulic oil pressure of the neutral flow path 18 of the second circuitry system S2 reaches a predetermined set pressure. As a result, the pilot pressure is supplied to one of the pilot chambers 58*a* of the regeneration passage switching valve 58, and the regeneration passage switching valve 58 is switched to the regeneration position. Furthermore, the hydraulic oil of the neutral flow path 18 is guided to the merging regeneration passage 46 through the passage 56, and an excess flow amount regeneration of the second circuitry system S2 is performed. The predetermined set pressure is set at a pressure slightly lower than the main relief pressure of the main relief valve 19.

When the solenoid proportional reducing valve 61 is switched and the excess flow amount regeneration control is performed, the controller C controls the tilt angle of the swash plate of the regeneration motor M by a regulator 66 so that the hydraulic oil pressure of the neutral flow paths 6 and 18 becomes not less than a minimum operating pressure of the operation valves 1 to 5, 14 to 17.

On the other hand, the other of the pilot chambers 58*b* of the regeneration passage switching valve 58 connects to the tank T via a second pilot passage 60. In the regeneration passage switching valve 58, no pilot pressure is supplied to the other pilot chamber 58*b*. The pilot chamber 58*b* is a chamber where the hydraulic oil sucked up from the tank T when the regeneration passage switching valve 58 is switched from the regeneration position to a normal position is flown in, and from which the hydraulic oil leaking out from a gap of the spool of the regeneration passage switching valve 58 is returned back to the tank T.

Next described are effects of the excess flow amount regeneration control.

When the hydraulic oil pressure of the neutral flow path 18 reaches a predetermined set pressure, the regeneration passage switching valve 58 of the passage 56 connected to the neutral flow path 18 is switched to the regeneration position, and the high pressure hydraulic oil of the second main pump MP2 is guided to the regeneration motor M.

Herein, although conventionally it was possible to regenerate energy from the excess amount of flow of the boom cylinder BC and swing motor RM by boom regeneration control and swing regeneration control while the boom cylinder BC and swing motor RM are in operation, in a case in which an actuator other than the boom cylinder BC or the swing motor RM is operated, it was not possible to regenerate energy.

On the contrary, in the present embodiment, for example in a case in which the hydraulic oil pressure of the neutral flow path 18 reaches a set pressure in a state in which the bucket, the arm or the like is operated, it is possible to guide the hydraulic oil excess within the neutral flow path 18 to the regeneration motor M, instead of discarding the excess hydraulic oil from the main relief valve 19. Since it is thus possible to perform regeneration from energy that was conventionally discarded, it is possible to reduce the energy loss and regenerate more energy. Therefore, it is possible to reduce the energy consumption of an entire system.

Moreover, when all the actuators are stopped, it is possible to guide a standby amount of flow of the neutral flow path 18 to the regeneration motor M. As a result, standby charge is performed, in which the regeneration motor M is rotated by use of a standby flow amount to generate electricity, and which can increase the amount of battery charge. In particular, the neutral cut valve 63 is disposed in the neutral flow path 18 of the second circuitry system S2, and thus can raise the hydraulic oil pressure of the neutral flow path 18 to near a main relief pressure. Since this causes excess amount of flow of a higher pressure to be guided to the regeneration motor M, it is possible to reduce the time required to charge the battery 27 to a predetermined battery capacity.

Furthermore, when the solenoid proportional reducing valve 61 is switched and excess flow amount regeneration control is performed, the controller C controls the tilt angle of the swash plate of the regeneration motor M by the regulator 66 so that the hydraulic oil pressure becomes not less than a minimum operating pressure of the operation valves 1 to 5, 14 to 17, of the neutral flow paths 6 and 18. As a result, it is possible to regenerate energy while maintaining the hydraulic oil pressure in the neutral flow paths 6 and 18 on a side in which the hydraulic oil is guided to the regeneration motor M.

Furthermore, since the neutral cut valve 63 is provided upstream from the pilot relief valve 21, it is possible to prevent the hydraulic oil pressure of the neutral flow path 18 from becoming relieved from the pilot relief valve 21 when the hydraulic oil pressure of the neutral flow path 18 reaches the set pressure and the neutral cut valve 63 is switched to the closed position. This allows for supplying a higher hydraulic oil pressure to the regeneration motor M at the time of the excess flow amount regeneration control, thus making it possible to regenerate more energy.

Next describes the assist control.

The sub-pump SP is a variable displacement pump whose swash plate is adjustable in its tilt angle, and is connected with the regeneration motor M to work together and rotate coaxially the regeneration motor M. The sub-pump SP rotates by a driving force of the electric motor 47. Rotation speed of the electric motor 47 is controlled by the controller C via an inverter 48. The sub-pump SP and the tilt angle of the swash plate of the regeneration motor M are controlled by the controller C via the regulators 67 and 66.

A discharge passage 68 is connected to the sub-pump SP, as an assist passage. The sub-pump SP allows for supplying the hydraulic oil to the neutral flow paths 6 and 18 via the discharge passage 68. The discharge passage 68 is formed by branching into a first discharge passage 69 merging with the passage 55 and a second discharge passage 70 merging with the passage 56. A high pressure selection switching valve 71 as an assist switching valve is interposed in the branched section of the discharge passage 68. The first discharge passage 69 and the second discharge passage 70 are provided with the check valves 72 and 73, respectively, the check valves 72 and 73 allow for just the flow of hydraulic oil from the discharge passage 68 to the passage 55 or passage 56.

The high pressure selection switching valve 71 is a switching valve of a six-port three-position spool type. The high pressure selection switching valve 71 has pilot chambers 71*a* and 71*b* disposed facing either end of the spool, respectively. To one of the pilot chambers 71*a*, the hydraulic oil of the passage 55 is supplied via the first pilot passage 76. To the other of the pilot chambers 71*b*, the hydraulic oil of the passage 56 is supplied via the second pilot passage 77. An attenuation throttle 74 is provided to the first pilot passage 76, and an attenuation throttle 75 is provided to the second pilot passage 77. The spool is supported at a neutral condition by a pair of centering springs 71*c* and 71*d* provided on either respective edge. The high pressure selection switching valve 71 is usually maintained at a normal position (state shown in FIG. 1 and FIG. 2) by a spring force of the centering springs 71*c* and 71*d*.

The high pressure selection switching valve 71, in a state maintained at a normal position, divides discharged oil of the sub-pump SP proportionately to the first discharge passage 69 and the second discharge passage 70.

When the pilot pressure of one of the pilot chambers 71*a* is higher than the pilot pressure of the other one of the pilot chambers 71*b*, the high pressure selection switching valve 71 is switched to a first switching position (right position in FIG. 1). This thus supplies the discharge oil of the sub-pump SP to the passage 55.

When the pilot pressure of the other pilot chamber 71*b* is higher than the pilot pressure of the one pilot chamber 71*a*, the high pressure selection switching valve 71 is switched to a second switching position (left position in FIG. 1). This thus supplies the discharge oil of the sub-pump SP to the passage 56.

That is to say, the high pressure selection switching valve 71 supplies the discharge oil of the sub-pump SP upon selecting one among the passages 55 and 56 that has a higher pressure. In the process in which the high pressure selection switching valve 71 is switched, the hydraulic oil is supplied to both the passages 55 and 56; in a case in which a differential pressure between one of the pilot pressures of the pilot chambers 71*a* and 71*b* and the other one of the pilot pressures of the pilot chambers 71*a* and 71*b* is sufficiently high, the entire amount of the discharge oil of the sub-pump SP is supplied to one of the passages 55 and 56 with the higher pressure, and completely none of the discharge oil is supplied to the one with the lower pressure.

When the sub-pump SP rotates by the driving force of the electric motor 47, the sub-pump SP assists at least one of the output of the first main pump MP1 and second main pump MP2. Whether to assist the first main pump MP1 or the second main pump MP2 is determined by the high pressure selection switching valve 71, and an automated assist requiring no control by the controller C is performed.

When the hydraulic oil is supplied to the regeneration motor M through the merging regeneration passage 46 and the regeneration motor M rotates, the rotation force of the regeneration motor M acts as an assist force against the electric motor 47 rotating coaxially. Therefore, it is possible to reduce the amount of electricity consumption of the electric motor 47 by the amount of rotation force of the regeneration motor M.

When the electric motor 47 is used as a generator, with the regeneration motor M serving as a driving source, the sub-pump SP has its tilt angle of the swash plate set to zero, and is substantially in a no load state.

The following describes the effects of the assist control.

The high pressure selection switching valve 71 is interposed on the discharge passage 68 that guides the hydraulic oil discharged from the sub-pump SP to the neutral flow paths 6 and 18, and the high pressure selection switching valve 71 selects one among the passages 55 and 56 that has higher pressure, and supplies the discharge oil of the sub-pump SP thereto. This allows for supplying more assist flow amount on the higher pressure side to the neutral flow paths 6 and 18 when the load on the actuator is high, which thus secures work speed of the hydraulic excavator.

Moreover, the high pressure selection switching valve 71 selects the higher pressure side passage of the passage 55 and the passage 56; this allows for supplying the hydraulic oil discharged from the sub-pump SP to the higher pressure side. Furthermore, in a conventional case in which for example the discharge oil of the sub-pump SP is discharged proportionally to the passage 55 and passage 56 via the proportional solenoid throttle valves, respectively, it is possible to prevent the occurrence of a throttle pressure loss in the proportional solenoid throttle valve, which causes a decrease in the assist power, and can reduce the energy consumption. Furthermore, since no proportional solenoid throttle valve is used, the assist system that supplies the discharge oil from the sub-pump SP to the neutral flow paths 6 and 18 can be of a low-cost and tough system.

Furthermore, since the hydraulic oil can be supplied to the neutral flow paths 6 and 18 by the sub-pump SP while performing swing regeneration control or boom regeneration control, in a case in which for example the arm is operated while the boom cylinder BC is contracted, a so-called horizontal pulling operation is performed, it is possible to assist the arm by regenerated power while performing regeneration by the boom regeneration control. Hence, it is possible to reduce the energy consumption as an entire system.

Furthermore, to one of the pilot chambers 71*a* of the high pressure selection switching valve 71, the hydraulic oil of the passage 55 is supplied via the attenuation throttle 74, and to the other pilot chamber 71*b*, the hydraulic oil of the passage 56 is supplied through the attenuation throttle 75. As a result, it is possible to prevent the spool of the high pressure selection switching valve 71 from suddenly moving, attenuate the switching operation between the neutral position, the first switching position, and the second switching position of the high pressure selection switching valve 71, and reduce any shock generated at the time of switching.

According to the above first embodiment, the effects shown below are attained.

Conventionally, although it was possible to carry out energy regeneration from the excess amount of flow of the boom cylinder BC or swing motor RM by the boom regeneration control or revolving regeneration control during the operation of the boom cylinder BC or swing motor RM, energy regeneration could not be performed while an actuator other than the boom cylinder BC or the swing motor RM is being operated.

On the other hand, in the present embodiment, for example, when the hydraulic oil pressure reaches a set pressure of the neutral flow path 18 in a state in which the bucket, the arm or the like is being operated, the regeneration passage switching valve 58 is switched to the regeneration position, and the hydraulic oil of the neutral flow path 18 is guided to the regeneration motor M. Hence, even in a case in which the actuator other than the boom cylinder BC or swing motor RM is being operated, it is possible to regenerate hydraulic energy of excess hydraulic oil. Therefore, since it is possible to regenerate energy from energy that conventionally was discarded, it is possible to reduce the energy loss and regenerate more energy, and thus reduce the energy consumption of the entire system.

Second Embodiment

Figure 3:
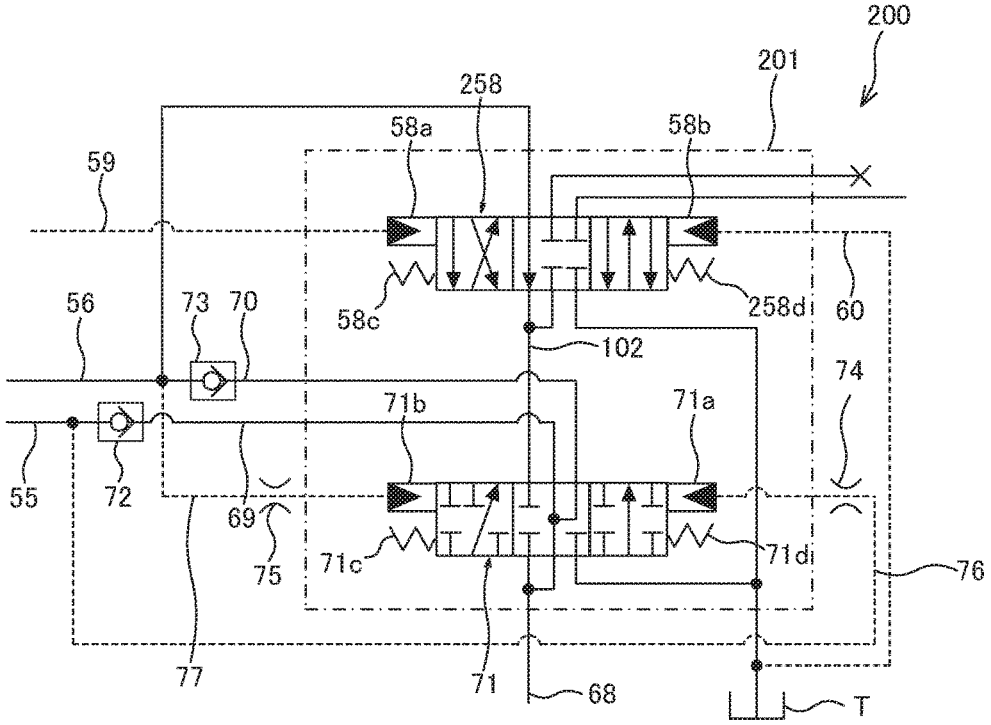
FIG. 3 is an enlarged view of a regeneration passage switching valve and a high pressure selection switching valve of a control system of a hybrid construction machine according to a second embodiment of the present invention.
Figure 4:
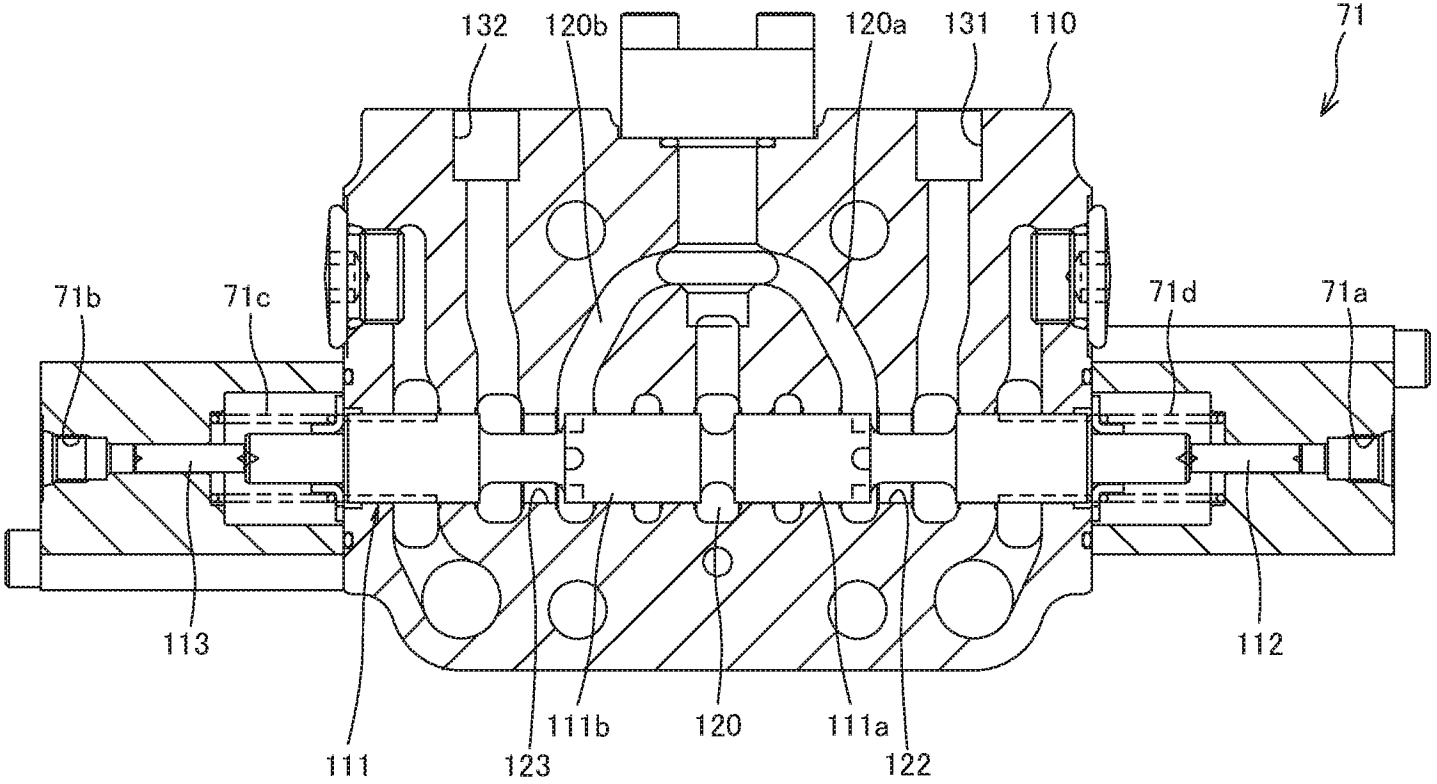
FIG. 4 is a cross sectional view of a high pressure selection switching valve.
Figure 5:
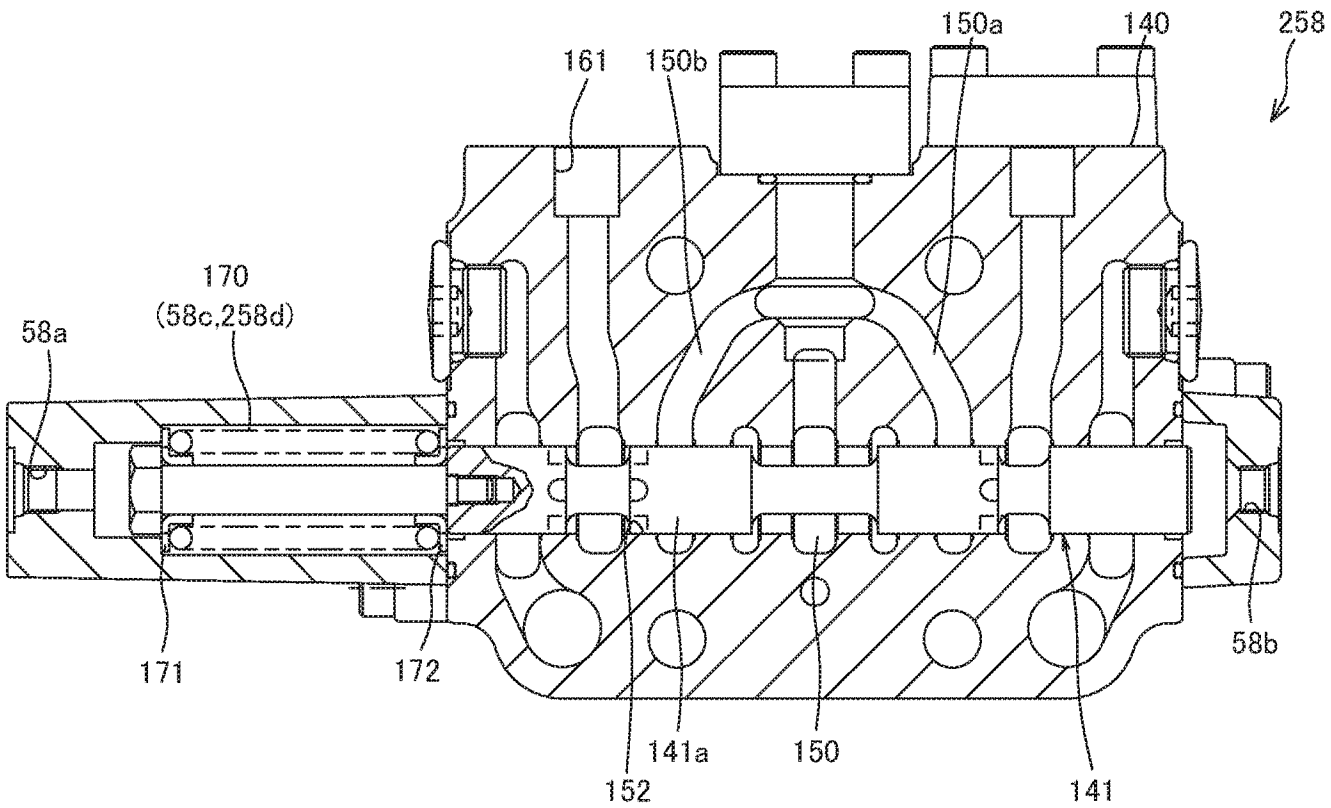
FIG. 5 is a cross sectional view of a regeneration passage switching valve.

With reference to FIG. 3 to FIG. 5, the following describes a control system 200 of a hybrid construction machine according to a second embodiment of the present invention. In each embodiment shown below, points different from the aforementioned first embodiment are mainly described, and configurations having similar functions as with the first embodiment are provided with identical reference signs and their descriptions are omitted.

The control system 200 of the hybrid construction machine differs from the first embodiment in a point that a valve device 201 using a general-purpose product of a section type is used instead of the valve device 101.

The valve device 201 includes a regeneration passage switching valve 258 that is switched at the time of the excess flow amount regeneration control, and a high pressure selection switching valve 71 that is switched at a time of the assist control.

The regeneration passage switching valve 258 is a switching valve of a six-port three-position spool type. The regeneration passage switching valve 258 has pilot chambers 58*a* and 58*b* provided facing either end of the spool, respectively. The spool is supported in neutral condition by a pair of centering springs 58*c* and 258*d* provided on each respective end. The regeneration passage switching valve 58 is usually maintained at a normal position (state shown in FIG. 3) by a spring force of the centering springs 58*c* and 258*d*.

The regeneration passage switching valve 258 includes a third position (right position in FIG. 3), in addition to the normal position and regeneration position of the regeneration passage switching valve 58 of the first embodiment.

The third position is provided facing the other pilot chamber 58*b*. The pilot chamber 58*b* is connected to the tank T via the second pilot passage 60. In the regeneration passage switching valve 58, no pilot pressure is supplied to the other pilot chamber 58*b*. The pilot chamber 58*b* is one in which hydraulic oil sucked up from the tank T is flown when the regeneration passage switching valve 58 is switched from the regeneration position to the normal position, and which the hydraulic oil leaking out from a gap of the spool of the regeneration passage switching valve 58 is returned to the tank T. Hence, the regeneration passage switching valve 258 will not be switched to the third position.

However, by having the regeneration passage switching valve 258 be a six-port three-position spool type switching valve as with the high pressure selection switching valve 71, it is possible to standardize components, which allows for cost reduction of the valve device 201.

Next described with reference to FIG. 4 and FIG. 5 is a specific configuration of the high pressure selection switching valve 71 and the regeneration passage switching valve 58.

As shown in FIG. 4, the high pressure selection switching valve 71 includes a valve housing 110 in which a flow path of hydraulic oil is formed, and a spool 111 that slidably moves in an axial direction within the valve housing 110.

The valve housing 110 has a supply passage 120 connected to the discharge passage 68, a pair of bridge passages 120*a* and 120*b* through which the hydraulic oil supplied from the supply passage 120 is branched and flown, ports 131 and 132 communicating with the passages 55 and 56, respectively, a communication passage 122 that allows the bridge passage 120*a* to communicate with the port 131, and a communication passage 123 that allows the bridge passage 120*b* to communicate with the port 132. The spool 111 has a large diameter part 111*a* that can close the communication passage 122, and a large diameter part 111*b* that can close the communication passage 123.

In a state in which the high pressure selection switching valve 71 is maintained in a normal position (state shown in FIG. 4), both the communication passages 122 and 123 that allow the bridge passages 120*a* and 120*b* to communicate with the ports 131 and 132, respectively. Therefore, the hydraulic oil supplied from the supply passage 120 are divided proportionally to the bridge passages 120*a* and 120*b*. The hydraulic oil that passes through the communication passages 122 and 123 are supplied to the passages 55 and 56 via the ports 131 and 132, respectively.

When the pilot pressure of the pilot chamber 71*a* is higher than the pilot pressure of the pilot chamber 71*b*, the pressure of the pilot chamber 71*a* wins over the energizing force of the centering spring 71*c* and the high pressure selection switching valve 71 causes the spool 111 to move and is switched to the first switching position. As a result, the large diameter part 111*b* of the spool 111 closes the communication of the bridge passage 120*b* with the port 132 in the communication passage 123. Hence, the hydraulic oil supplied from the supply passage 120 passes through the bridge passage 120*a* and the communication passage 122, and is supplied to the passage 55 via the port 131.

When the pilot pressure of the pilot chamber 71*b* is higher than the pilot pressure of the pilot chamber 71*a*, the pressure of the pilot chamber 71*b* wins over the energizing force of the centering spring 71*d* and the high pressure selection switching valve 71 causes the spool 111 to move and is switched to the second switching position. As a result, the large diameter part 111*a* of the spool 111 closes the communication of the bridge passage 120*a* with the port 131 in the communication passage 122. Hence, the hydraulic oil supplied from the supply passage 120 passes through the bridge passage 120*b* and the communication passage 123, and is supplied to the passage 56 via the port 132.

Small-diameter pistons 112 and 113 formed having smaller diameters compared to the spool 111, are provided on respective ends of the spool 111. The spool 111 switches the high pressure selection switching valve 71 between a normal position, a first switching position and a second switching position by being pressed against the small-diameter pistons 112 and 113. The small-diameter pistons 112 and 113 are provided separately to the spool 111. The small-diameter pistons 112 and 113 are pressed by the pressure of the hydraulic oil of each of the passages 55 and 56 as pilot pressures. By providing the small-diameter pistons 112 and 113, the area receiving the pilot pressure caused by the hydraulic oil supplied to the pilot chambers 71*a* and 71*b* is reduced. Therefore, compared to a case in which no small-diameter pistons 112 and 113 is provided, it is possible to reduce the force that acts on the spool 111.

Particularly, in a case of the high pressure selection switching valve 71, a high pressure hydraulic oil discharged from the first main pump MP1 and the second main pump MP2 are supplied to the pilot chambers 71*a* and 71*b*. Accordingly, in the high pressure selection switching valve 71, the force acting on the spool 111 is reduced by providing the small-diameter pistons 112 and 113.

As shown in FIG. 5, the regeneration passage switching valve 258 includes a valve housing 140 in which a flow path of the hydraulic oil is formed, and a spool 141 that slidably moves in an axial direction within the valve housing 140.

The valve housing 140 has a supply passage 150 connected to the passage 56, a pair of bridge passages 150*a* and 150*b* through which the hydraulic oil supplied from the supply passage 150 flows in a branched manner, a port 161 communicating with the merging regeneration passage 46, and a communication passage 152 that allows the bridge passage 150*b* to communicate with the port 161. The spool 141 has a large diameter part 141*a* that can close the communication passage 152.

The valve housing 140 is provided stacked on the valve housing 110 of the high pressure selection switching valve 71 so that the supply passage 150 can communicate with the supply passage 120 via the neutral flow path 102 (see FIG. 3). However, as described above, the port on the high pressure selection switching valve 71 side does not communicate with the neutral flow path 102 in any of the switched positions. Hence, in the present embodiment, the supply passage 150 and the supply passage 120 will not actually communicate with each other.

In a state in which the regeneration passage switching valve 258 is maintained in the normal position (state shown in FIG. 5), the communication between the bridge passage 150*b* and the port 161 in the communication passage 152 is in a closed state. Therefore, the hydraulic oil supplied from the supply passage 150 stops at the bridge passages 150*a* and 150*b*.

When the pressure force caused by the pilot pressure of the pilot chamber 58*a* is greater than the energizing force of the centering spring 258*d*, the pressure of the pilot chamber 58*a* wins over the energizing force of the centering spring 258*d* and the regeneration passage switching valve 258 moves the spool 141 to switch to the regeneration position. As a result, the large diameter part 141*a* of the spool 141 moves to communicate the communication passage 152. Hence, the hydraulic oil supplied from the supply passage 150 passes through the bridge passage 150*b* and the communication passage 152, and is supplied to the merging regeneration passage 46 via the port 161.

In the regeneration passage switching valve 58, the centering spring 58*c* and the centering spring 258*d* are a unit of a spring 170. On both ends of the spring 170, spring sheets 171 and 172 are provided, respectively.

When the spool 141 is switched over to the regeneration position (left position in FIG. 3), one of the spring sheets 171 moves as a result of the movement of the spool 141 and compresses the spring 170. As a result, the spring 170 functions as the centering spring 258*d*.

As such, by making the centering spring 58*c* and the centering spring 258*d* be a unit of the spring 170, the number of springs can be reduced and the total length of the regeneration passage switching valve 258 can be made small. Hence, it is possible to reduce the size and weight of the valve device 101.

Moreover, as shown in FIG. 4 and FIG. 5, the valve housing 140 of the regeneration passage switching valve 258 is a component identical to the valve housing 110 of the high pressure selection switching valve 71. These valve housings 140 and 110 are commonly used general-purpose products of a section type. Hence, since the regeneration passage switching valve 258 and the high pressure selection switching valve 71 are configured using the general-purpose valve housings 140 and 110, it is possible to reduce the costs for the valve device 201.

According to the above second embodiment, the following effects are attained.

The valve housing 140 of the regeneration passage switching valve 258 is a component identical to the valve housing 110 of the high pressure selection switching valve 71. These valve housings 140 and 110 are commonly used general-purpose products of a section type. Therefore, by making the regeneration passage switching valve 258 be a six-port three-position spool type switching valve as with the high pressure selection switching valve 71, it is possible to standardize the components and reduce the costs for the valve device 201.

Third Embodiment

Figure 6:
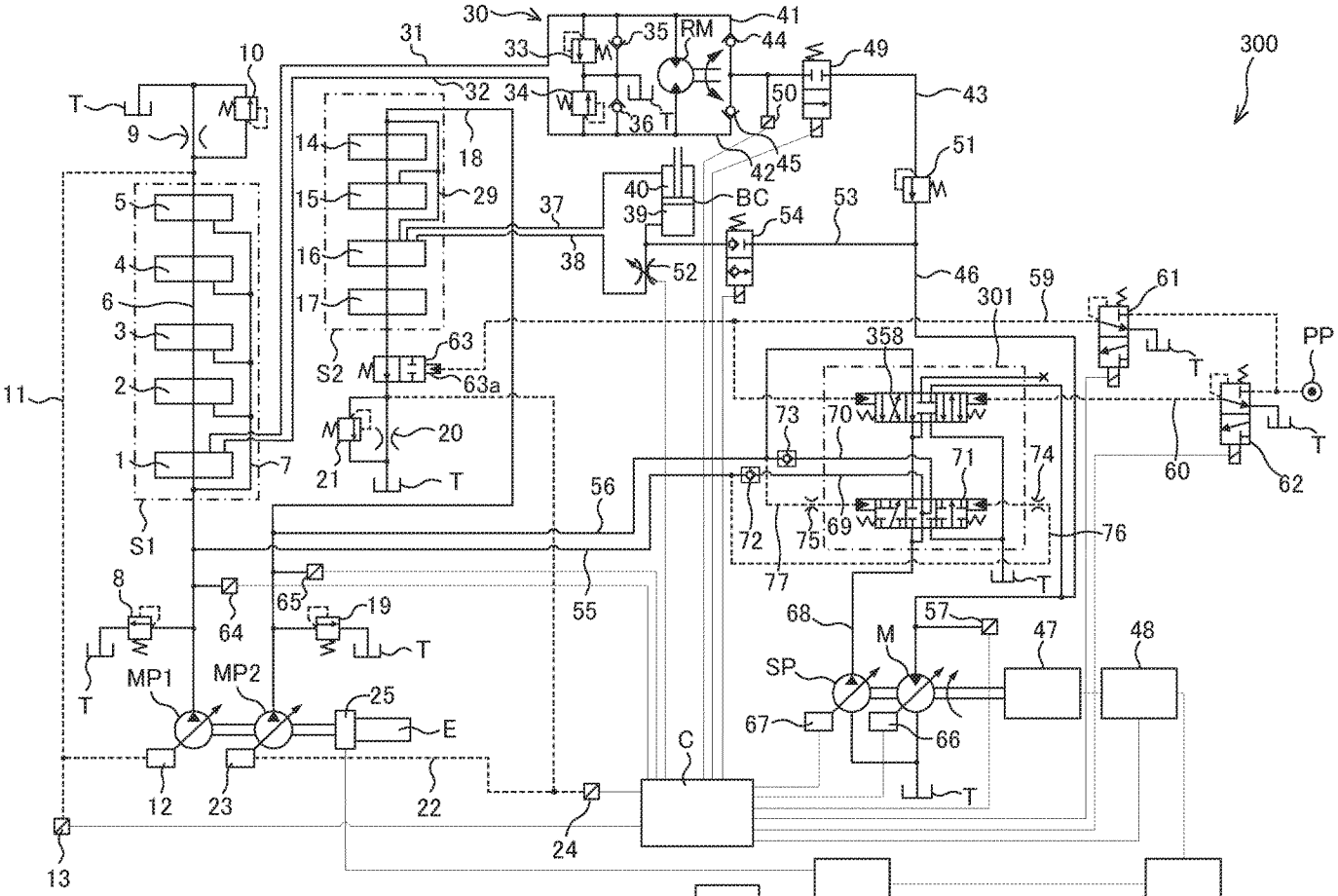
FIG. 6 is a circuit diagram of a control system of a hybrid construction machine according to a third embodiment of the present invention.
Figure 7:
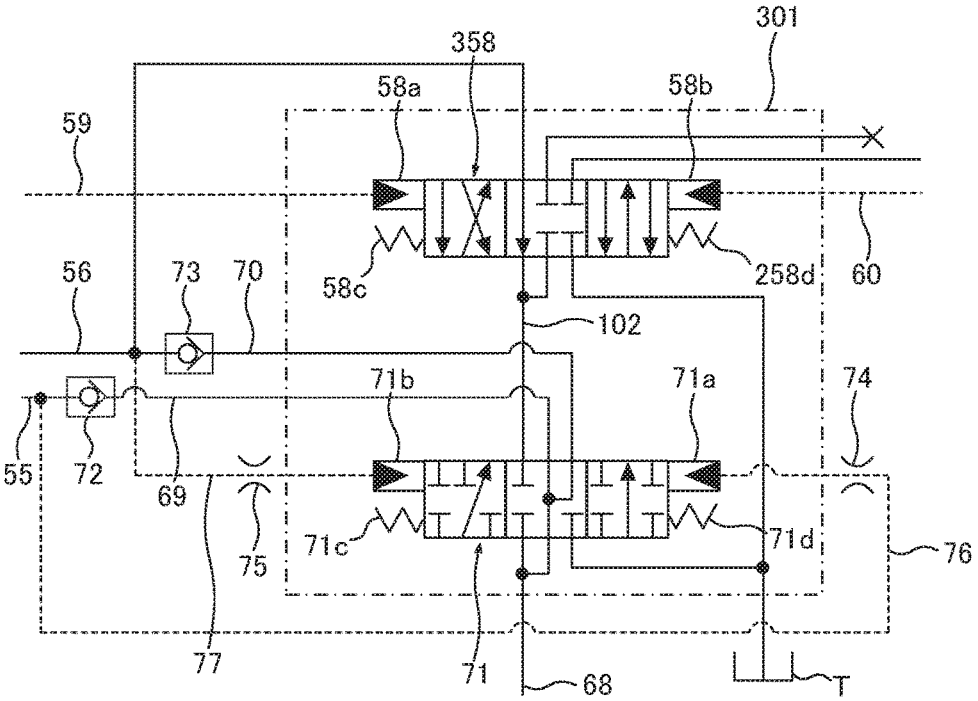
FIG. 7 is an enlarged view of a regeneration passage switching valve and a high pressure selection switching valve in FIG. 6.
Figure 8:
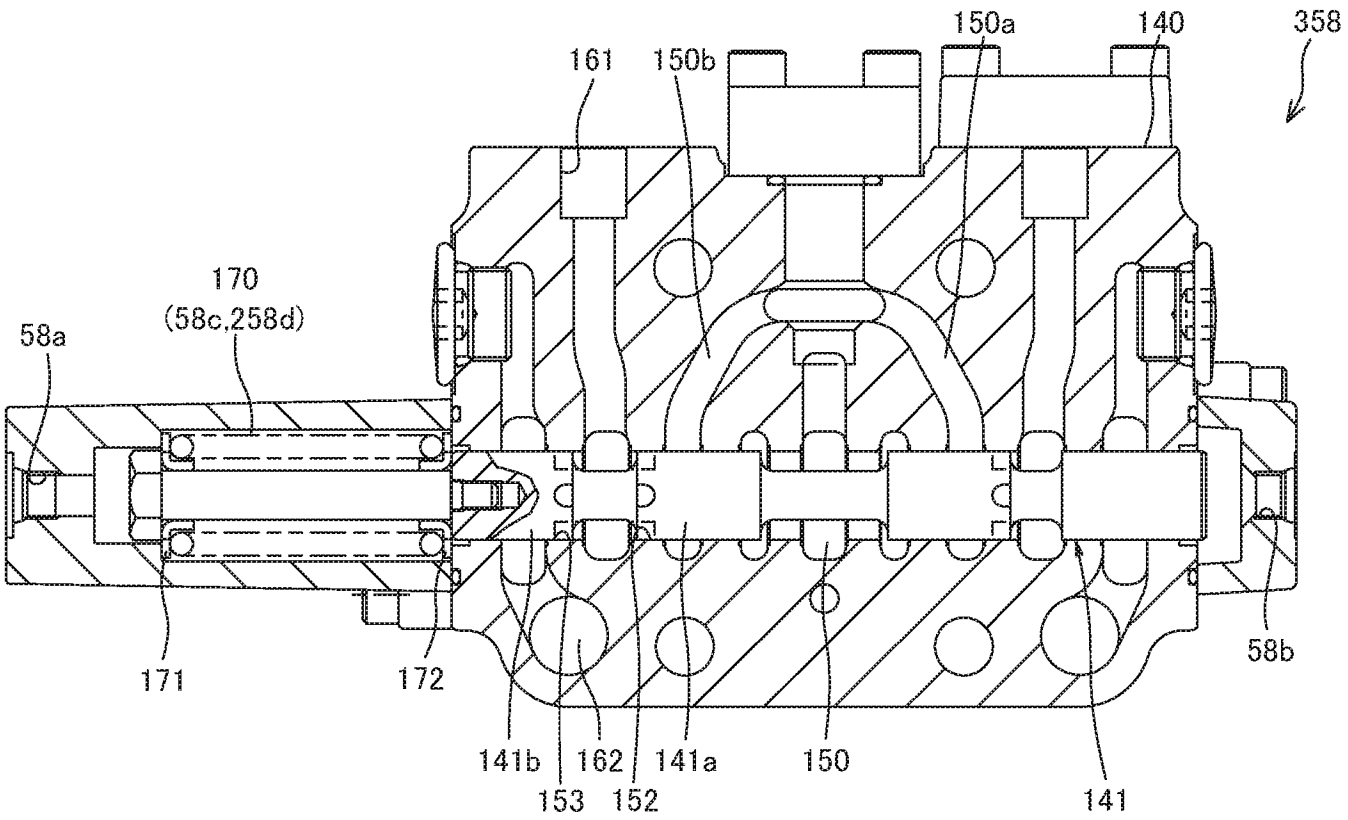
FIG. 8 is a cross sectional view of a regeneration passage switching valve.

With reference to FIG. 6 to FIG. 8, the following describes a control system 300 of a hybrid construction machine of a third embodiment of the present invention.

The control system 300 of the hybrid construction machine differs from the aforementioned embodiments in a point that the regeneration passage switching valve 358 of the valve device 301 includes a tank communication position and a solenoid proportional reducing valve 62 for guiding a pilot pressure to switch to the tank communication position to the regeneration passage switching valve 358.

The valve device 301 includes a regeneration passage switching valve 358 that is switched at the time of the excess flow amount regeneration control, and a high pressure selection switching valve 71 at the time of the assist control.

The regeneration passage switching valve 358 is a switching valve of a six-port three-position spool type. The regeneration passage switching valve 358 is provided with pilot chambers 58*a* and 58*b* facing either ends of the spool, respectively. The spool is supported in a neutral state by a pair of centering springs 58*c* and 258*d* provided on either ends, respectively. The regeneration passage switching valve 358 is usually maintained at the normal position (state shown in FIG. 6 and FIG. 7) by a spring force of the centering springs 58*c* and 258*d*.

The regeneration passage switching valve 358 includes a tank communication position (right position in FIG. 6 and FIG. 7), in addition to the normal position and the regeneration position in the regeneration passage switching valve 58 of the first embodiment.

The regeneration passage switching valve 358 is switched to the tank communication position when the pilot pressure is supplied to the other pilot chamber 58*b*, and allows the flow of the hydraulic oil from the merging regeneration passage 46 to the tank T while keeping the passage 56 closed, and when the supply of pilot pressure is blocked, the regeneration passage switching valve 358 is switched to the normal position and blocks the communication between the merging regeneration passage 46 and the tank T.

The pilot pressure supplied to the pilot chamber 58*b* is supplied from the pilot pressure source PP through the second pilot passage 60. In the second pilot passage 60, a solenoid proportional reducing valve 62 is interposed, the solenoid proportional reducing valve 62 is capable of outputting proportional pilot pressure force in accordance with a command signal from the controller C. On the basis of a command signal outputted from the controller C, the solenoid proportional reducing valve 62 reduces pressure of the pilot pressure source PP and generates a pilot pressure in accordance with a command value when the solenoid is excited, and supplies the pilot pressure to the second pilot passage 60.

When the amount of the hydraulic oil within the merging regeneration passage 46 flowing into the regeneration motor M exceeds a defined value, the controller C causes the regeneration passage switching valve 358 to switch to the tank communication position and controls to communicate the merging regeneration passage 46 with the tank T.

More specifically, the merging regeneration passage 46 is provided with a pressure sensor 57 for detecting the pressure of the hydraulic oil guided to the regeneration motor M. In the present embodiment, the pressure of the hydraulic oil is equivalent to the flow-in amount of the hydraulic oil. Instead, a flowmeter for detecting the amount of flow of the hydraulic oil may be provided, and the detected amount of flow may serve as the flow-in amount of the hydraulic oil. When the controller C determines that the pressure detected by the pressure sensor 57 reaches the pressure in the defined value, the controller C outputs a signal that switches the solenoid proportional reducing valve 62 to supply a pilot pressure to the pilot chamber 58*b* of the regeneration passage switching valve 358.

Herein, the defined value is a value set in advance based on a pressure of the hydraulic oil to be supplied to the regeneration motor M. More specifically, based on the pressure signal from the pressure sensor 57, the controller C determines as reaching the defined value in a case in which an amount of flow of hydraulic oil excess of an amount of flow that can be supplied to the regeneration motor M is supplied to the regeneration motor M, and the pressure of the merging regeneration passage 46 increases.

As described above, the controller C switches the regeneration passage switching valve 358 to the tank communication position when the amount of flow of the hydraulic oil to be supplied to the regeneration motor M is in excess. As a result, the hydraulic oil within the merging regeneration passage 46 becomes unloaded to the tank T. Therefore, it is possible to prevent the amount of flow of the hydraulic oil guided to the regeneration motor M from becoming excess in amount.

Moreover, based on the pressure signal from the pressure sensor 57, the controller C switches the regeneration passage switching valve 358 to the tank communication position even in a case in which the inside of the merging regeneration passage 46 becomes a negative pressure. For example, in a case for instance in which the so-called slope tamping work of contracting the boom cylinder BC and lowering the boom to press the bucket against the ground is carried out, the amount of flow of the hydraulic oil supplied from the boom cylinder BC to the regeneration motor M suddenly decreases. In such a case, there may be a case in which the inside of the merging regeneration passage 46 becomes a negative pressure.

In the present embodiment, the regeneration passage switching valve 358 is switched to the tank communication position, so when the supplied amount of hydraulic oil to the regeneration motor M becomes insufficient, it is possible to suck up the hydraulic oil from the tank T to the merging regeneration passage 46 and supply the hydraulic oil to the regeneration motor M.

Thereafter, based on the pressure signal from the pressure sensor 57, when the controller C determines that the supplied amount of the hydraulic oil to the regeneration motor M is sufficient, the controller C makes the solenoid of the solenoid proportional reducing valve 62 in an unexcited state and switches the regeneration passage switching valve 358 from the tank communication position to the normal position.

As described above, based on the pressure signal from the pressure sensor 57, the controller C switches the regeneration passage switching valve 358 to the tank communication position even in a case the inside of the merging regeneration passage 46 becomes a negative pressure. As a result, in a case in which the supplied amount of the hydraulic oil to the regeneration motor M becomes insufficient, the hydraulic oil can be sucked up from the tank T to the merging regeneration passage 46 and be supplied to the regeneration motor M. Hence, it is possible to prevent the lack of the supplied amount of hydraulic oil to the regeneration motor M, and protect the regeneration motor M.

Moreover, in the control system 100 of the hybrid construction machine according to the first embodiment, a suction passage 78 was provided that sucks up the hydraulic oil from the tank T to the merging regeneration passage 46, and supplies the hydraulic oil to the regeneration motor M when the supplied amount of hydraulic oil to the regeneration motor M becomes insufficient. In comparison, with the control system 300 of the hybrid construction machine according to the present embodiment, the regeneration passage switching valve 358 includes the tank communication position, so there is no need to provide the suction passage 78.

Next described is a specific configuration of the regeneration passage switching valve 358, with reference to FIG. 8.

As shown in FIG. 8, the regeneration passage switching valve 358 includes a valve housing 140 in which a flow path of the hydraulic oil is formed, and a spool 141 that slidably moves in an axial direction within the valve housing 140.

The valve housing 140 has a supply passage 150 connected to the passage 56, a pair of bridge passages 150*a* and 150*b* through which the hydraulic oil supplied from the supply passage 150 flows in a branched manner, a port 161 communicating with the merging regeneration passage 46, a tank passage 162 communicating with the tank T, a communication passage 152 that allow the bridge passage 150*b* to communicate with the port 161, and a communication passage 153 that allows the port 161 to communicate with the tank passage 162. The spool 141 has a large diameter part 141*a* that can close the communication passage 152, and a large diameter part 141*b* that can close the communication passage 153.

In a state in which the regeneration passage switching valve 358 is maintained at a normal position (state shown in FIG. 6 and FIG. 7), the communication passages 152 and 153 are both closed. Therefore, the communication between the bridge passage 150*b* and the port 161 is closed, and the communication between the port 161 and the tank passage 162 is closed. Hence, the hydraulic oil supplied from the supply passage 150 stops at the bridge passages 150*a* and 150*b*.

In a case in which the pilot pressure of the pilot chamber 58*a* is higher than the pilot pressure of the pilot chamber 58*b*, the pressure of the pilot chamber 58*a* wins over the energizing force of the centering spring 258*d* and the regeneration passage switching valve 358 causes the spool 141 to move and is switched to the regeneration position. As a result, the large diameter part 141*a* of the spool 141 is moved and establishes communication of the communication passage 152. Hence, the hydraulic oil supplied from the supply passage 150 passes through the bridge passage 150*b* and the communication passage 152, and is supplied to the merging regeneration passage 46 via the port 161.

In a case in which the pilot pressure of the pilot chamber 58*b* is higher than the pilot pressure of the pilot chamber 58*a*, the pressure of the pilot chamber 58*b* wins over the energizing force of the centering spring 58*c*, and the regeneration passage switching valve 358 causes the spool 141 to move and is switched to the tank communication position. As a result, the large diameter part 141*b* of the spool 141 is moved and establishes communication of the communication passage 153. Hence, the hydraulic oil supplied from the merging regeneration passage 46 passes through the communication passage 153 and is returned to the tank T via the tank passage 162.

When the spool 141 is switched to the tank communication position, the other one of the spring sheets 172 moves as a result of the movement of the spool 141 and compresses the spring 170. As a result, the spring 170 functions as the centering spring 58*c*.

According to the above third embodiment, the following effects are attained.

The controller C switches the regeneration passage switching valve 358 to the tank communication position, in a case in which the flow-in amount of the hydraulic oil guided from the boom cylinder BC or swing motor RM to the regeneration motor M through the merging regeneration passage 46 exceeds a defined value. As a result, the hydraulic oil within the merging regeneration passage 46 is guided to the tank T. Therefore, it is possible to prevent the amount of flow of the hydraulic oil guided to the regeneration motor M from becoming in excess.

Moreover, the controller C switches the regeneration passage switching valve 358 to the tank communication position even if the inside of the merging regeneration passage 46 becomes a negative pressure. As a result, even if the supplied amount of hydraulic oil to the regeneration motor M becomes insufficient, the hydraulic oil can be sucked up from the tank T to the merging regeneration passage 46 and be supplied to the regeneration motor M. Hence, it is possible to prevent the supplied amount of hydraulic oil to the regeneration motor M from becoming insufficient, and can protect the regeneration motor M.

Embodiments of this invention were described above, but the above embodiments are merely examples of applications of this invention, and the technical scope of this invention is not limited to the specific constitutions of the above embodiments.

This application claims priority based on Japanese Patent Application No. 2014-011518 filed with the Japan Patent Office on Jan. 24, 2014, the entire contents of which are incorporated into this specification.

The invention claimed is:

1. A control system of a hybrid construction machine, comprising:

two circuitry systems each having a main pump and an operation valve, the operation valve being configured to supply and discharge working fluid supplied from the main pump to an actuator through a main passage;

a main relief valve disposed in at least one of the two circuitry systems, the main relief valve being configured to maintain the working fluid pressure of the main passage at not more than a main relief pressure;

two regeneration passages each branching out between the main pump and the operation valve of the main passage of the two circuitry systems;

a regeneration motor for regeneration, configured to rotate by the working fluid guided through one of the regeneration passages of the two circuitry systems;

an assist pump configured to supply the working fluid to the two main passages via an assist passage by rotation with the regeneration motor interlockingly;

a regeneration passage switching valve configured to open and close one of the regeneration passages of the two circuitry systems; and an assist switching valve interposed on the assist passage, the assist switching valve being configured to supply the working fluid supplied from the assist pump to at least one of the two regeneration passages, wherein the regeneration passage switching valve includes a normal position where flow of the working fluid is blocked, and a regeneration position allowing for the working fluid to flow from the main passage to the regeneration motor when the working fluid pressure of the main passage reaches a set pressure lower than the main relief pressure during operation of the actuator, and the assist switching valve includes a normal position proportionally dividing the working fluid of the assist passage into the two regeneration passages, a first switching position supplying more working fluid of the assist passage to one of the two main passages when that the one of the two main passages has a higher working fluid pressure, and a second switching position supplying more working fluid of the assist passage to the other one of the two main passages when that the other one of the two main passages has a higher working fluid pressure.

2. The control system of the hybrid construction machine according to claim 1, further comprising:

a controller configured to perform regeneration control of the hybrid construction machine, wherein the controller controls regeneration flow amount of the regeneration motor to make a working fluid pressure of the two main passages be not less than a minimum operating pressure of the actuator, when the regeneration passage switching valve is controlled to switch to the regeneration position.

3. The control system of the hybrid construction machine according to claim 1, further comprising:

a pressure detector configured to detect a working fluid pressure of one of the two main passages;

a pilot pressure source configured to generate a pilot pressure; and a solenoid valve interposed on a pilot passage for supplying the pilot pressure to switch the regeneration passage switching valve to the regeneration position, the solenoid valve allowing the pilot passage to communicate with the pilot pressure source, wherein the solenoid valve is switched to communicate the pilot passage with the pilot pressure source when the working fluid pressure detected by the pressure detector reaches the set pressure during operation of the actuator.

4. The control system of the hybrid construction machine according to claim 3, further comprising:

a throttle connected downstream of the operation valve of the main passage, the throttle being configured to generate a pilot pressure transmitted to a regulator for controlling a capacity of the main pump; and a main passage switching valve interposed between the operation valve and the throttle in the main passage, configured to open and close the main passage, wherein the main passage switching valve is switched to a closed position when the solenoid valve is switched to communicate the pilot passage with the pilot pressure source.

5. The control system of the hybrid construction machine according to claim 1, wherein the regeneration motor is also configured to be driven by working fluid discharged from the actuator through a merging regeneration passage at which the working fluid from one of the regeneration passages of the two circuitry systems merge, and the regeneration passage switching valve further includes a tank communication position that allows the merging regeneration passage to communicate with a tank when a flow-in amount to the regeneration motor of the working fluid within the merging regeneration passage exceeds a defined value.

6. The control system of the hybrid construction machine according to claim 1, wherein the assist switching valve includes:

a spool configured to close a communication between the assist passage and the two regeneration passages; and a pair of small-diameter pistons formed with a smaller diameter than that of the spool, the pair of small-diameter pistons being provided on either respective ends of the spool, wherein the spool switches between the normal position, the first switching position, and the second switching position by being pressed against the small-diameter piston pressed by the pressure of working fluid of the two regeneration passages as a pilot pressure.

* * * * *